US007118258B2

(12) United States Patent
Yamamura et al.

(10) Patent No.: US 7,118,258 B2
(45) Date of Patent: Oct. 10, 2006

(54) VEHICULAR HEADLAMP

(75) Inventors: Satoshi Yamamura, Shizuoka (JP); Kenichi Takada, Shizuoka (JP); Masao Kinoshita, Shizuoka (JP); Masahito Naganawa, Shizuoka (JP); Motohiro Komatsu, Shizuoka (JP); Mitsuyuki Mochizuki, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 79 days.

(21) Appl. No.: 11/038,225

(22) Filed: Jan. 21, 2005

(65) Prior Publication Data

US 2005/0162861 A1 Jul. 28, 2005

(30) Foreign Application Priority Data

Jan. 23, 2004 (JP) ..... P.2004-015544
Sep. 30, 2004 (JP) ..... P.2004-286572

(51) Int. Cl.
*F21V 7/00* (2006.01)

(52) U.S. Cl. ..... 362/514; 362/517; 362/280; 362/282; 362/284

(58) Field of Classification Search ..... 362/296, 362/512, 514, 516, 517, 518, 277, 280, 282, 362/284, 319, 322, 323, 324
See application file for complete search history.

(56) References Cited

U.S. PATENT DOCUMENTS 6,179,455 B1 * 1/2001 Taniuchi ..... 362/507
6,607,295 B1 * 8/2003 Hayakawa ..... 362/517
6,857,768 B1 * 2/2005 Watanabe et al. ..... 362/512
6,953,272 B1 * 10/2005 Hayakawa et al. ..... 362/517
7,008,093 B1 * 3/2006 Fukawa et al. ..... 362/539
2001/0021112 A1 9/2001 Taniuchi et al.
2002/0044453 A1 * 4/2002 Naganawa et al. ..... 362/539

FOREIGN PATENT DOCUMENTS

JP 229715 A 8/2001

* cited by examiner

*Primary Examiner*—Thomas M. Sember
(74) *Attorney, Agent, or Firm*—Sughrue Mion, PLLC

(57) ABSTRACT

A projection-type vehicular headlamp structure that is capable of forming at least two types of light distribution in at least two modes, and is also capable of controlling the radiated light thereof with high precision in addition to keeping to a minimum any noticeable difference when switching between modes. A portion of a reflector is structured as a mobile reflection portion which may separate from a remaining reflective portion. An additional reflector is disposed generally behind the mobile reflective portion. The additional reflector is incident to light from a light source when the mobile reflective portion is separated from the remaining reflective portion. Light incident from the mobile reflective portion, the remaining reflective portion, and the additional reflector is reflected forward to a projection lens of the vehicular headlamp, providing illumination in the area preceding a vehicle's traveling path.

7 Claims, 11 Drawing Sheets

VEHICULAR HEADLAMP

BACKGROUND OF THE INVENTION

1. Technical Field

The present invention relates to a projection-type vehicular headlamp.

2. Description of the Related Art

Generally, a projection-type vehicular headlamp is structured such that a projection lens is disposed on an optical axis that extends in vehicle's longitudinal direction, while a light source is disposed to the rear of a rear-side focal point of the projection lens, and light from the light source is reflected toward the optical axis by a reflector. When forming a low-beam distribution pattern from a projection-type vehicular headlamp, a portion of reflected light from a reflector in the vicinity of the rear side focal point of the projection lens is blocked by a shade disposed at an upper end edge near the optical axis. A predetermined cut-off line is thus formed on an upper end portion of the low-beam distribution pattern.

Unexamined Japanese Patent Publication No. 2001-229715 describes a projection-type vehicular headlamp that is structured with a first additional reflector disposed in front of and obliquely below a light source, and a second additional reflector disposed above the light source adjacent to the reflector so as to sequentially reflect light from the light source with the first additional reflector and the second additional reflector. Furthermore, the projection-type headlamp is structured with a shutter disposed between the first additional reflector and the second additional reflector so as to make it possible to prevent reflected light from the first additional reflector from becoming incident to the second additional reflector.

In order to improve visibility of a road surface in front of the vehicle using light radiated from the vehicular headlamp, it is desirable for a plurality of various light distribution patterns to be formed depending on a vehicle's traveling condition, even for identical low-beam distribution patterns.

In the vehicular headlamp described in Unexamined Japanese Patent Publication No. 2001-229715, opening and closing the shutter allows for the formation of a low-beam distribution pattern in two modes: a normal low-beam distribution pattern mode, and a low-beam distribution pattern mode wherein a light distribution pattern formed by light sequentially reflected from the first and second additional reflectors is added to the normal low-beam distribution pattern. However, the following problems exist.

first problem exists in the vehicular headlamp described in Unexamined Japanese Patent Publication No. 2001-229715 whereby light is reflected twice by the first and second additional reflectors. This twice reflected light is further radiated forward without passing through the projection lens, thus leading to the inability to control the radiated light with high precision. An additional problem exists whereby the light distribution pattern formed by light sequentially reflected by the first and second additional reflectors differs in quality from the low-beam distribution pattern formed by light from the light source that is reflected by the reflector and which passes through the projection lens. Both the inability to control radiated light with high precision and the noticeable difference in the quality of the light distribution pattern when switching between modes are problematic for obvious reasons. Similar problems are also found in prior art headlamps when forming a high-beam distribution pattern, or the like.

BRIEF SUMMARY OF THE INVENTION

The present invention was devised in view of the foregoing. The present invention provides a vehicular headlamp structured as a projection-type vehicular headlamp that is capable of forming two types of light distribution modes and capable of controlling the radiated light thereof with high precision, in addition to keeping any perceptible difference to a minimum when switching between modes.

The present invention is structured with a portion of a reflector that is separated and made mobile, and where a predetermined additional reflector is disposed in a rear vicinity thereof, such that reflected light from the additional reflector passes through a projection lens.

Namely, a vehicular headlamp according to an exemplary embodiment of the present invention is provided with a projection lens that is disposed on an optical axis that extends in a longitudinal direction of the vehicle in which the light is attached. Further, a light source is disposed to a rear side of a rear side focal point of the projection lens, and a reflector that reflects light from the light source is located in a forward direction toward the optical axis, and is further characterized in that a portion of the reflector is structured as a mobile reflective portion so as to allow separation from a remaining general reflective portion and movement in a predetermined direction.

The above exemplary embodiment of the invention includes an additional reflector that is provided in a rear vicinity of the mobile reflective portion, to which light is incident from the light source that passes between the mobile reflective portion and the general reflective portion when the mobile reflective portion separates from the general reflective portion and moves in the predetermined direction, and such incident light is reflected forward toward the optical axis.

A light distribution pattern formed by light radiated from the vehicular headlamp according to an exemplary embodiment of the present invention may be a low-beam distribution pattern, a high-beam distribution pattern, or other light distribution pattern.

The type of above-described light source is not particularly limited and, for example, may comprise a light-emitting portion of a discharge bulb or a filament of a halogen bulb. In addition, the specific structure of the light source is not particularly limited. For example, the specific position and direction of the present invention's light source may be of many different types, provided that the light source which is used is disposed closer to a rear side than to the rear side focal point in reference to the projection lens.

The specific position, size, reflective surface contour and the like of the above mobile reflective portion are not particularly limited, provided that a portion of the reflector is structured so as to allow separation from the remaining general reflective portion in the reflector and movement in a predetermined direction. The mode of movement of the above mobile reflective portion is not particularly limited either, and for example, may include movement according to a linear motion or movement according to a rotational motion. In addition, the form of movement may be a form that allows the setting of two positions: a pre-separation first position and a second position consisting of a predetermined movement in the predetermined direction from the first position. The form of movement may also allow for setting at least one position between these two positions in a staged or continuous manner.

The specific direction of the above predetermined direction is not particularly limited, and may include, for example, a direction such as an up direction, down direction, or right-left direction.

The size, specific reflective surface contour and the like of the additional reflector mentioned above is not particularly limited, as long as the additional reflector is provided in a rear vicinity of the mobile reflective portion, and light is incident from the light source to pass between both reflective portions when the mobile reflective portion separates from the general reflective portion and moves in the predetermined direction, such incident light being reflected forward toward the optical axis from the additional reflector (among other reflective areas).

As indicated in the structure described above, the vehicular headlamp according to an exemplary embodiment of the present invention is configured as a projection-type vehicular headlamp, wherein a portion of the reflector is structured as a mobile reflective portion so as to allow separation and movement in the predetermined direction from a remaining general reflective portion in the reflector, and an additional reflector is provided in a rear vicinity of the mobile reflective portion, to which light is incident from a light source that passes between the mobile reflective portion and the general reflective portion when the mobile reflective portion separates from the general reflective portion and moves in a predetermined direction, wherein such incident light is reflected forward toward the optical axis.

In a state where the mobile reflective portion is in the pre-separation first position, it is possible to form the first light distribution pattern by radiating reflected light forward from the mobile reflective portion and the general reflective portion via the projection lens. In a state where the mobile reflective portion is moved to the second position that is a predetermined distance downward from the first position, it is possible to form the second light distribution by radiating reflected light forward from the general reflective portion and the additional reflector via the projection lens (in this case, reflected light from the mobile reflective portion may also be added depending on the amount of movement of the mobile reflective portion). In this case, setting the reflective surface contour of the additional reflector to an appropriate shape allows the second light distribution pattern to have a shape and light intensity distribution that are different from the first light distribution pattern.

Furthermore, it is possible to form an intermediate light distribution pattern in-between the first light distribution pattern and the second light distribution pattern at an intermediate position between the first position and the second position. In this case, the additional reflector directly reflects light from the light source, and this reflected light passes through the projection lens so as to be radiated toward the forward direction. Therefore, radiated light can be controlled with high precision, and it is possible for the resulting light distribution pattern formed to have a quality identical to the light distribution pattern formed by light from the light source, which is reflected by the reflector and passes through the projection lens.

Thus, according to an exemplary embodiment of the present invention, a projection-type vehicular headlamp structure is capable of forming two types of light distribution modes and controlling the radiated light thereof with high precision, in addition to keeping any noticeable difference when switching between modes to a minimum. Moreover, such an effect can be realized in a lamp unit that is capable of being compactly structured.

Furthermore, the present invention has a structure that switches between modes through movement of the mobile reflective portion, which has a function for controlling light reflection. Therefore, light from the light source can be more effectively utilized compared to a conventional case in which a shutter was opened or closed to switch between modes.

In the above-described configurations of exemplary embodiments of the invention, if the additional reflector is structured to have a reflective surface contour with a high tendency to condense light toward a vicinity of the rear side focal point of the projection lens, the light distribution pattern formed by reflected light from the additional reflector can be formed as a spot-shaped light distribution pattern brighter than the light distribution pattern formed by reflected light from the mobile reflective portion. Thus, long distance visibility in the second position can be increased more than that in the first position.

In this case, the reflective surface contour with a high tendency to condense light toward a vicinity of the rear side focal point signifies a reflective surface contour in which the tendency to condense light from the light source reflected toward the vicinity of the rear side focal point by the additional reflector is higher than the tendency to condense light from the light source reflected toward the vicinity of the rear side focal point by the mobile reflective portion of the reflector. The specific shape thereof is not particularly limited, and for example, a substantially rotational ellipsoid surface contour with a point in the vicinity of the light source as a first focal point, and the rear side focal point of the projection lens as a second focal point, may be employed.

Additionally, the form of movement for the above-described mobile reflective portion is not particularly limited. If a configuration is used in which the movement is performed according to a rotational motion with a point in the vicinity of the light source as a rotation center, then a portion of reflected light from the mobile reflective portion in the second position can be made incident to the projection lens to radiate forward, thereby preventing large disturbances from occurring in the light distribution patterns when switching between the modes of the first position and the second position.

In the above configuration, if the light source is structured from a light-emitting portion of a light source bulb inserted in the reflector from a side of the optical axis so as to be located in a position below the optical axis, then the following effects can be obtained.

Namely, in an exemplary embodiment of the invention, inserting a light bulb source into the reflector from a side of an optical axis allows the longitudinal size of the lamp to be shortened, thereby enabling the lamp to be made more compact. In addition, a structure in which the light source bulb is inserted into the reflector so as to be located in a position below the optical axis allows an optical axis side area of a reflective surface of the reflector to be utilized effectively for light distribution control. Moreover, a diffusion region of a light distribution pattern is formed by light reflected from the optical axis side area, enabling sufficient brightness to be secured in the diffusion region.

The amount of downward displacement from the optical axis of the insertion position of the light source bulb is not particularly limited. However, from the standpoint of preventing light from the light source bulb that is reflected in the area in the proximity of the optical axis on the reflective surface of the reflector from being blocked by the light source bulb, it is preferable that a value of approximately 10 mm or more be set for the amount of downward displacement, and it is even more preferable that a value of approximately 15 mm or more be set. On the other hand, from the standpoint of securing a sufficient incident light flux to the reflective surface of the reflector from the light source bulb, it is preferable that the amount of downward displacement be set to a value of approximately 30 mm or less.

If the mobile reflective portion is disposed substantially directly behind the light source, and a separation position of an upper end edge of the mobile reflective portion and a lower end edge of the general reflective portion is set to a position at generally the same height as the optical axis, then the following effects can be obtained.

Namely, disposing the mobile reflective portion substantially directly behind the light source allows a sufficient light ray bundle to be secured with light from the light source regarding any one of the general reflective, mobile reflective and additional reflector portions. In addition, setting the separation position of an upper end edge of the mobile reflective portion and a lower end edge of the general reflective portion as a position at generally the same height as the optical axis allows all of a reflected area above the optical axis to be secured as the general reflective portion. Consequently, a basic light distribution pattern can be formed by reflected light from the general reflective portion as a light distribution pattern with a sufficiently bright diffusion region.

In the above configuration, if the light source is structured from a light-emitting portion of a light source bulb inserted in the reflector from a rear side on the optical axis, and the mobile reflective portion is disposed substantially directly above the optical axis, then the following effects can be obtained.

If the light source is structured as a line segment light source extending in the longitudinal direction on the optical axis, an inverted projection image of the light source is formed by light from the light source reflected in a reflected area substantially directly above the optical axis in the reflector. This inverted projection image has a substantially vertically oblong shape, and is formed so as to extend from a central area of the light distribution pattern to a lower end rim area, thereby brightly illuminating a short distance of the road surface area in front of the vehicle. Furthermore, if a structure is used that disposes the mobile reflective portion of the reflector substantially directly above the optical axis with the ability to change the position and size of the inverted projection image with a substantially vertically oblong shape through movement thereof, then the lower end rim area of the light distribution pattern can be darkened while increasing the central light intensity. Thus, an area of the road surface far away from the front of the vehicle can be sufficiently lit without excessively lighting up a closer area thereof. Consequently, long distance visibility can be sufficiently increased.

In the above configuration, if a shade for blocking a portion of reflected light from the reflector is disposed in a vicinity of the rear side focal point of the projection lens so as to position an upper end edge thereof in a vicinity of the optical axis, then a low-beam distribution pattern with a cut-off line can be formed on the upper end edge. Furthermore, in this case, the additional reflector is structured such that light from the light source reflected by the additional reflector is made incident to the projection lens. Thus a light distribution pattern formed by reflected light from the first additional reflector can also have a cut-off line on the upper end edge. Consequently, long distance visibility can be increased without blinding a driver of an oncoming vehicle with glare.

BRIEF DESCRIPTION OF THE DRAWINGS

Hereinafter, embodiments of the present invention are described with reference to the following drawings.

DETAILED DESCRIPTION OF EMBODIMENTS

Figure 1:
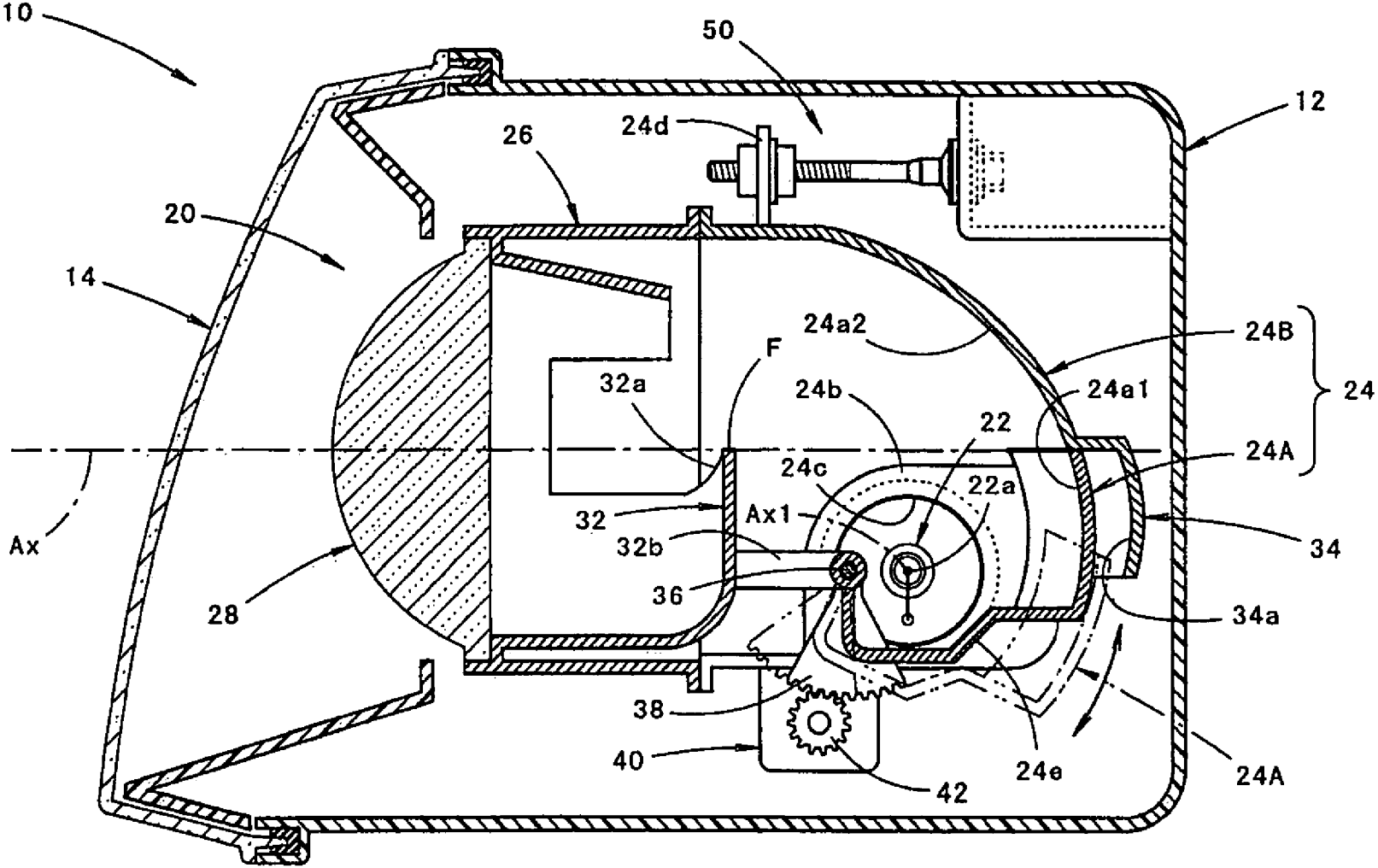
FIG. 1 is a lateral cross-sectional view showing a vehicular headlamp according to an exemplary, non-limiting embodiment of the present invention.

FIG. 1 is a lateral cross-sectional view showing a vehicular headlamp according to an exemplary embodiment of the present invention.

As shown in the figure, a vehicular headlamp 10 is structured such that a lamp unit 20, which has an optical axis Ax that extends in a longitudinal direction of the headlamp's vehicle, is stored inside a lamp chamber that is formed by a lamp body 12 and a generally translucent cover 14 that is attached to a front end opening portion of the lamp body 12. The headlamp 10 is tiltable in the vertical and the lateral directions through an aiming mechanism 50.

In an additional, exemplary embodiment of the invention, at a stage when aiming adjustment as performed by the aiming mechanism 50 is completed the optical axis Ax of the lamp unit 20 is configured so as to extend in a downward-oriented direction by approximately 0.5 to 0.6°.

Figure 2:
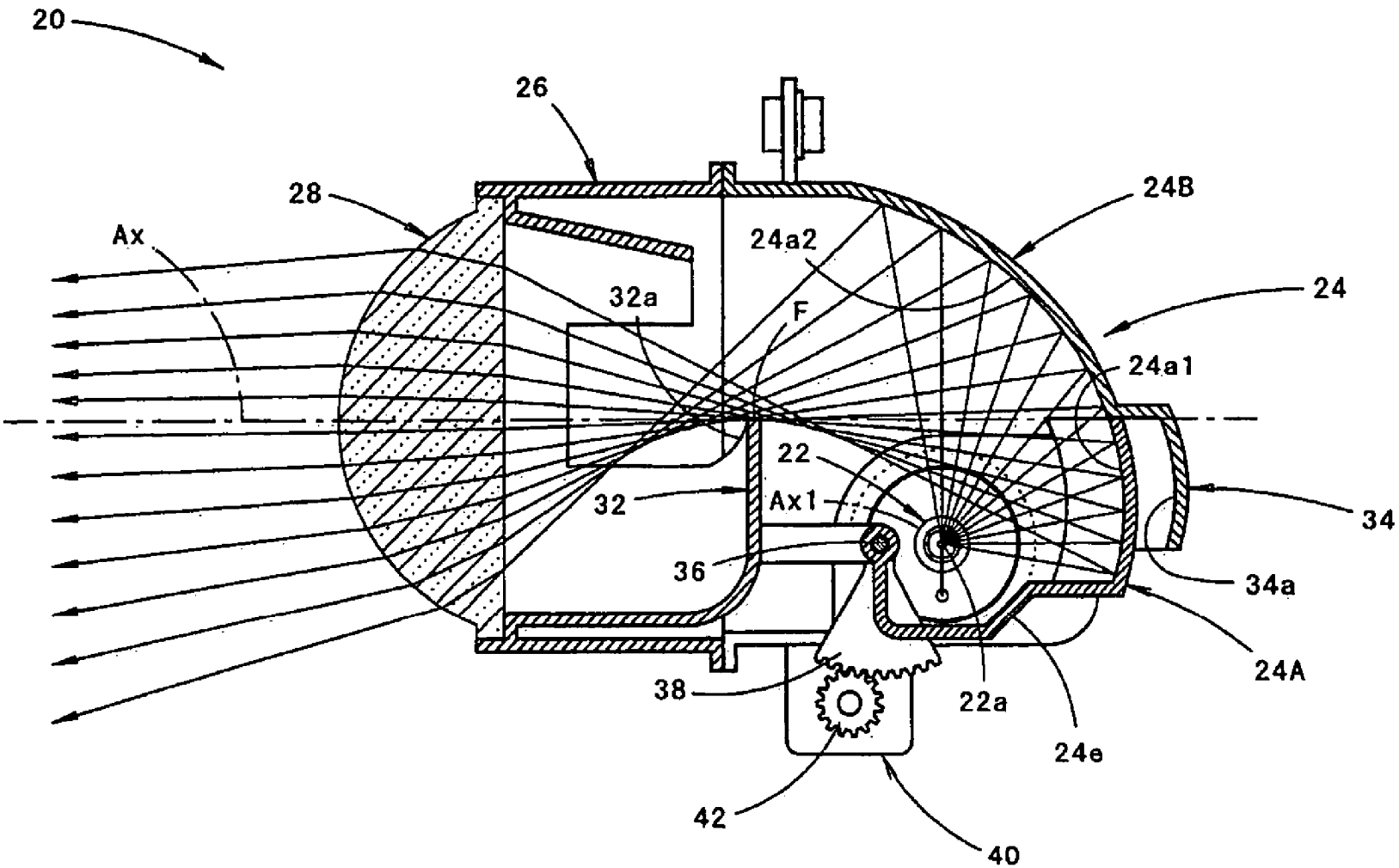
FIG. 2 is a lateral cross-sectional view showing a single lamp unit of the vehicular headlamp, and a view showing a light path in a state where a mobile reflective portion of a reflector is in a first position according to an exemplary, non-limiting embodiment of the present invention.
Figure 3:
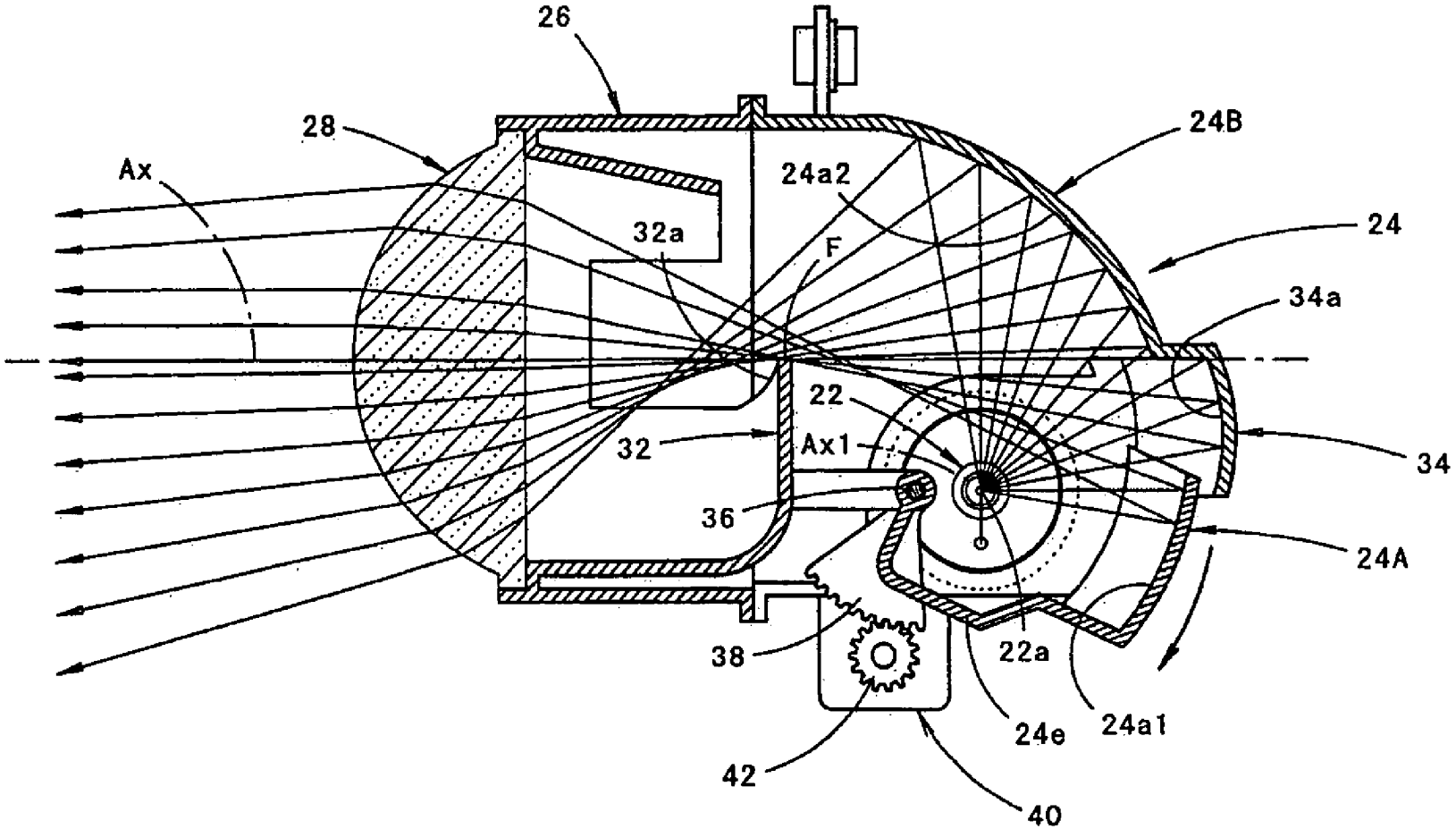
FIG. 3 is a lateral cross-sectional view showing the single lamp unit, and a view showing a light path in a state where the mobile reflective portion is in a second position according to an exemplary, non-limiting embodiment of the present invention.
Figure 4:
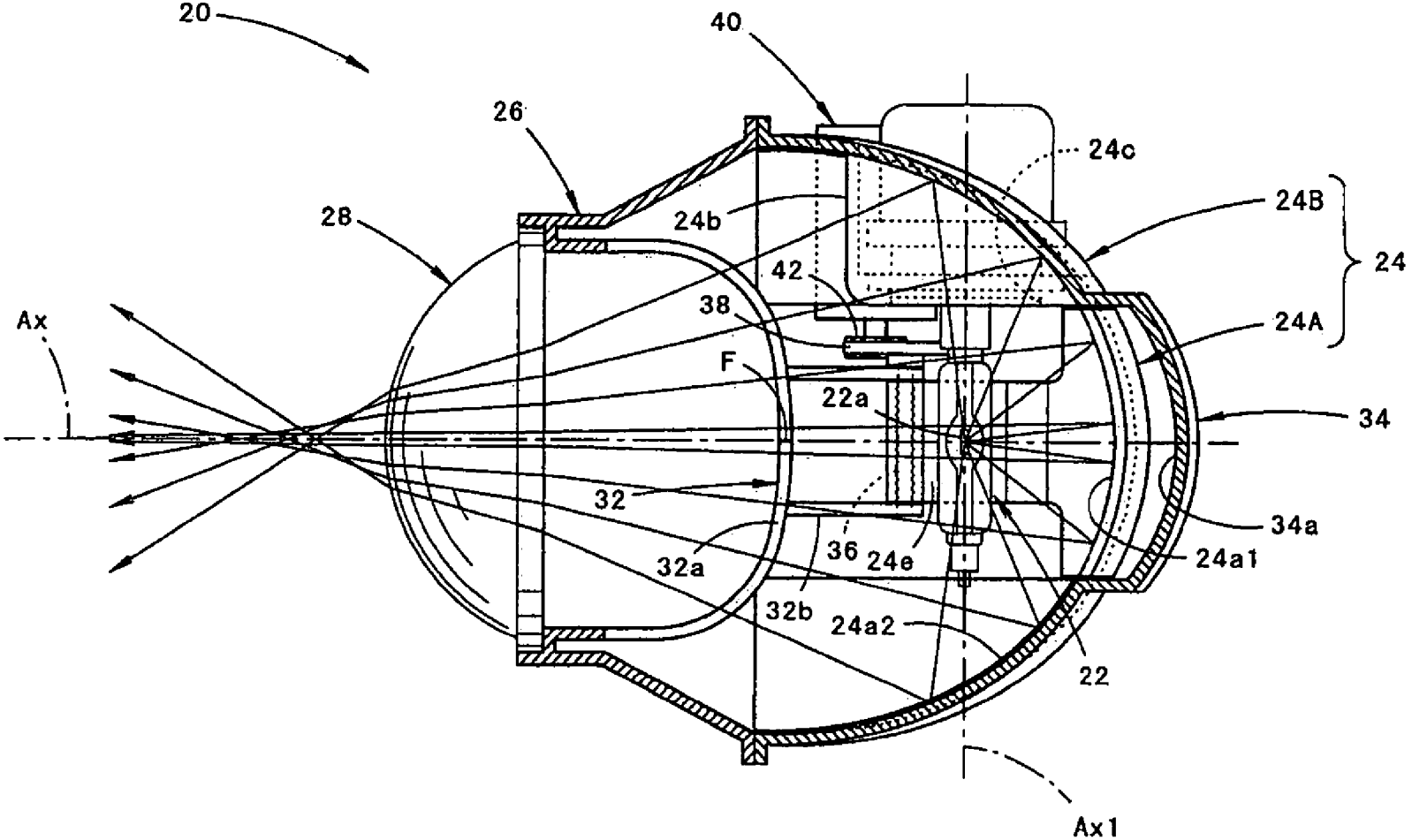
FIG. 4 is a top, cross-sectional view showing the single lamp unit, and a view showing a light path in a state where the mobile reflective portion is in the first position according to an exemplary, non-limiting embodiment of the present invention.
Figure 5:
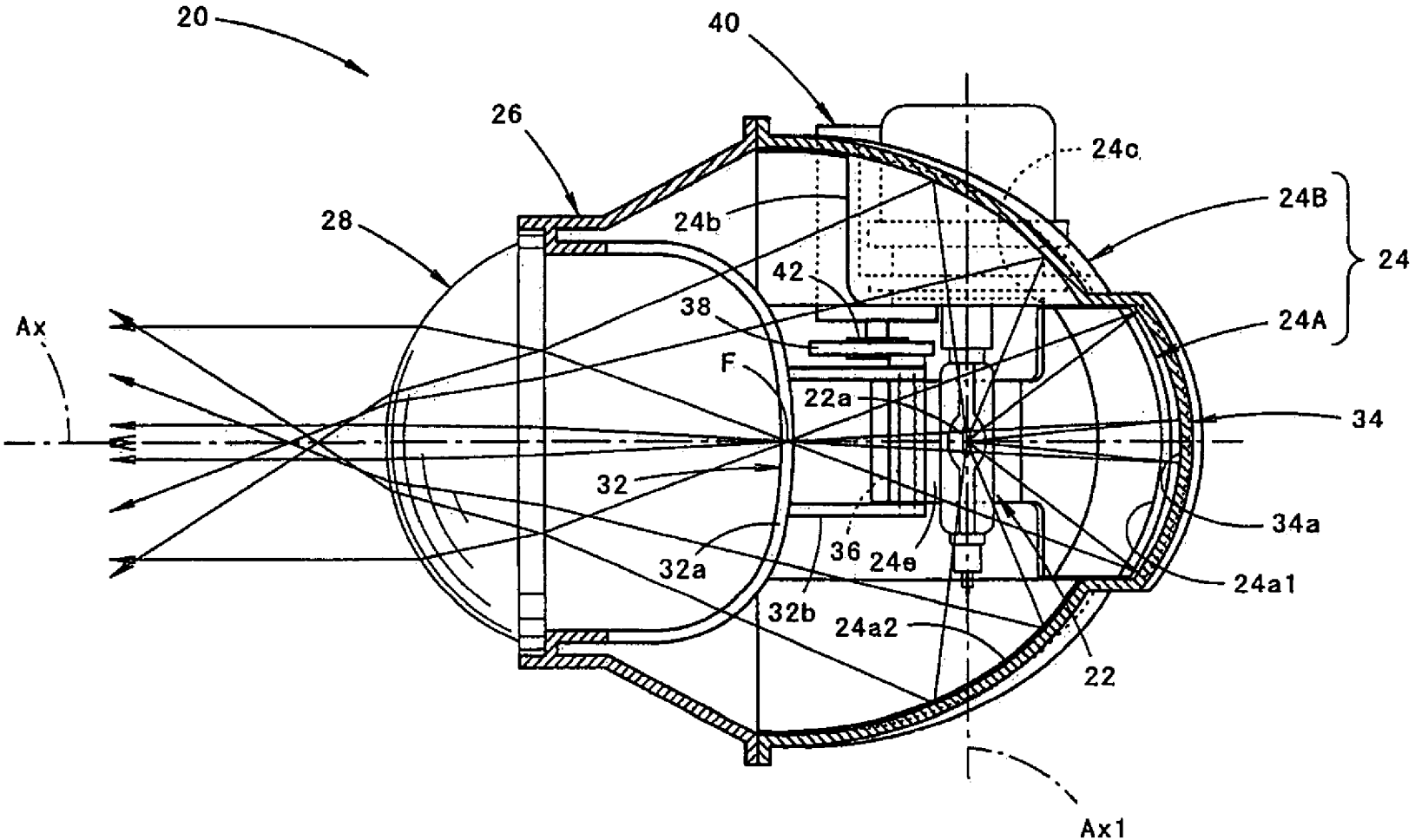
FIG. 5 is a top, cross-sectional view showing the single lamp unit, and a view showing a light path in a state where the mobile reflective portion is in the second position according to an exemplary, non-limiting embodiment of the present invention.

FIGS. 2 and 3 are lateral cross-sectional views each showing a single unit of a lamp unit 20 according to exemplary embodiments of the invention. FIGS. 4 and 5 are plane cross-sectional views each showing a single unit of a lamp unit 20 according to exemplary embodiments of the invention.

As shown in FIGS. 2–5, lamp unit 20 is a projection-type lamp unit and includes a light source bulb 22, a reflector 24, a holder 26, a projection lens 28, a shade 32, and an additional reflector 34.

The projection lens 28 is disposed on the optical axis Ax, and may comprise a planoconvex lens wherein a front side surface is a convex surface and a rear side surface is a flat plane. In addition, the projection lens 28 is configured so as to project an image on a focal plane (including a rear side focal point F) in a forward direction as an inverted image.

A light source bulb 22 is a discharge bulb such as a metal halide bulb or the like, with a discharging light source used as a light source 22*a*. The light source 22*a* is structured as a line segment light source that extends in the direction of a bulb central axis Ax1. In addition, the light source bulb 22 is inserted to the reflector 24 from the right side of the optical axis Ax so as to locate the light source bulb 22 in a position to the rear side of the rear side focal point F of the projection lens 28 and below the optical axis Ax (for example, in a position approximately 20 mm below the optical axis Ax). The light source bulb 22 is inserted such that the light emission center of the light source 22*a* is positioned vertically below the optical axis Ax, in a state where the bulb central axis Ax1 is set so as to extend in the horizontal direction within a vertical plane that is orthogonal to the optical axis Ax.

In an exemplary embodiment, the reflector 24 has a mobile reflective portion 24A positioned substantially directly behind the light source 22*a* and is otherwise formed from a general reflective portion 24B. The reflector 24 is structured so as to reflect light from the light source 22*a* forward towards the optical axis Ax. More specifically, a reflective surface 24*a*1 of the mobile reflective portion 24A and a reflective surface 24*a*2 of the general reflective portion 24B are formed in a shape with a continuous surface. The reflective surfaces 24*a*1, 24*a*2 have a substantially ellipsoid-shaped cross section, with an eccentricity thereof set so as to gradually increase from a vertical cross section toward a horizontal cross section. Thus as shown in FIGS. 2 and 4, light from the light source 22*a* reflected by the reflective surfaces 24*a*1, 24*a*2 substantially converges near the rear side focal point F in the vertical cross section. Notably, the convergence position of light in the horizontal cross section is located considerably forward in overall relation to lamp unit 20.

The reflective surface 24*a*1 of the mobile reflective portion 24A has a horizontally oblong exterior shape in a front view of the lamp unit. The reflective surface 24*a*2 of the general reflective portion 24B is formed so as to surround the mobile reflective portion 24A from above and on both right and left sides. In The reflective surface 24*a*1 of the mobile reflective portion 24A is formed in a range approximately 20 mm on both the right and the left sides of the optical axis Ax, and over a range extending approximately 25 mm below the height of the optical axis Ax.

A bulb insertion fixing portion 24*b* is formed in a lower right side area of the general reflective portion 24B so as to protrude from the reflective surface 24*a*2, and a bulb insertion hole 24*c* is formed in a left surface portion of the bulb insertion fixing portion 24*b*. In addition, the reflector 24 is supported by a lamp body 12 via the aiming mechanism 50 with an aiming bracket 24*d*, wherein the aiming bracket 24*d* may be formed in three places thereof. While only one position of the aiming bracket 24*d* is shown, the skilled artisan readily comprehends that a multiplicity of aiming brackets may be formed practically anywhere between the lamp unit 20 and the body 12 of headlamp 10.

The mobile reflective portion 24A is structured so as to allow separation and movement downward from the general reflective portion 24B. Namely, a bracket 24*e* is integrally formed on a lower end portion of the mobile reflective portion 24A, and extends up to a front vicinity of the light source 22*a* (for example, approximately 10 mm in front of a bulb central axis Ax1). A rotating axial member 36 extending in the vehicular lateral direction is fixed (for example, by press fitting) on a front end portion of the bracket 24*e*. The mobile reflective portion 24A is designed so as to allow rotation together with the rotating axial member 36 around an axial line from a first position (i.e., a position at which the mobile reflective portion 24A is not separated from the general reflective portion 24B) shown by a solid line in FIG. 1, to a second position (i.e., a position at which the mobile reflective portion 24A has separated from the general reflective portion 24B and moved a maximum extent downward) shown by a two-dotted broken line in the same figure. This rotational motion is performed, for example, in a continuous manner (or in stages) through driving of a stepping motor 40 fixed to a bottom surface wall of the general reflective portion 24B.

Figure 6:
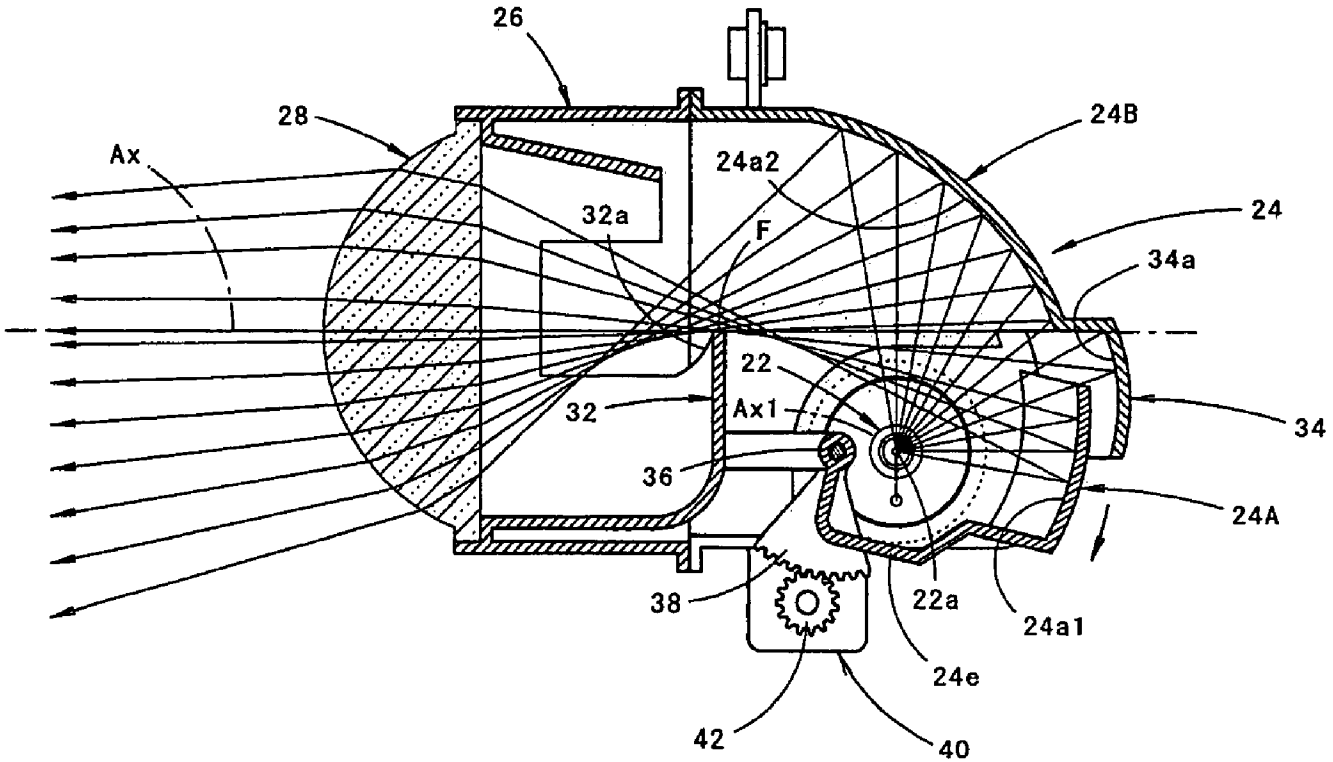
FIG. 6 is a lateral cross-sectional view showing the single lamp unit, and a view showing a light path in a state where the mobile reflective portion is in a third position according to an exemplary, non-limiting embodiment of the present invention.

FIGS. 2 and 4 illustrate a path of light from the light source 22*a* in a state where the mobile reflective portion 24A is in the first position. FIGS. 3 and 5 illustrate a path of light from the light source 22*a* in a state where the mobile reflective portion 24A is in the second position. Furthermore, FIG. 6 shows a path of light from the light source 22*a* in a state where the mobile reflective portion 24A is in a third position, which is between the first position and the second position.

The additional reflector 34 is provided in close vicinity to, and behind, the mobile reflective portion 24A of the reflector 24, and is integrally formed with the general reflective portion 24B of the reflector 24. A reflective surface 34*a* of the additional reflector 34 has a horizontally oblong exterior shape in reference to a front view of the lamp unit. In addition, the reflective surface 34*a* of the additional reflector 34 is formed in a range approximately 20 mm on both right and left sides of the optical axis Ax, and over a range extending approximately 20 mm below the height of the optical axis Ax. Furthermore, at times when the mobile reflective portion 24A of the reflector 24 has separated from the general reflective portion 24B and moved downward, the additional reflector 34 is designed to reflect light incident from the light source 22*a* passing between both reflective portions 24A, 24B forward towards the optical axis Ax.

The reflective surface 34*a* of the additional reflector 34 in this case has a surface contour with a high tendency to condense light toward the vicinity of the rear side focal point F of the projection lens 28. More specifically, the surface contour of the reflective surface 34*a* is set as a rotational ellipsoid with the center of radiated light from the light source 22*a* as a first focal point, and the rear side focal point F of the projection lens 28 as a second focal point.

The holder 26 is formed so as to extend in a generally cylindrical shape from a front end opening portion of the reflector 24 to a rear end portion thereof. The rear end portion is supported by the reflector 24 and the front end portion supports the projection lens 28.

The shade 32 is integrally formed with the holder 26 so as to be positioned substantially in a lower half of internal space of the holder 26. The shade 32 is formed such that an upper end edge 32*a* thereof passes through the rear side focal point F of the projection lens 28, thereby blocking a portion of the light reflected from the reflective surfaces 24*a*1, 24*a*2 of the reflector 24 or the reflective surface 34*a* of the additional reflector 34 and removing much of the upward-oriented light that is emitted forward from the projection lens 28.

A pair of right and left brackets 32*b* protruding to the rear is formed on a back surface of the shade 32 so as to support both end portions of the rotating axial member 36 in a rear end portion of the left and right brackets 32*b*. A sector gear 38 is fixed on a right end portion of the rotating axial member 36, and the sector gear 38 is disposed so as to mesh with a pinion 42 fixed to an output shaft of the stepping motor 40. The sector gear 38 rotates together with the rotating axial member 36 through driving of the stepping motor 40, thereby rotating the mobile reflective portion 24A.

The stepping motor 40 is driven based upon a control signal from a control unit (not shown) depending on the vehicle traveling condition. More specifically, the rotation position of the mobile reflective portion 24A is fixed to the first position in a low vehicle speed zone (e.g., a speed zone that is slower than 20 mp/h (miles per hour)), and is fixed to the second position in a high vehicle speed zone (e.g., a speed zone that is faster than 55 mp/h). Furthermore, in an intermediate vehicle speed zone (e.g., between 30 and 50 mp/h), the rotation position of the mobile reflective portion 24A is gradually changed from near the first position toward the second position in accordance with an increase in the vehicle's speed.

As shown in FIGS. 2 and 4, only reflected light from the reflective surface 24*a*1 of the mobile reflective portion 24A and the reflective surface 24*a*2 of the general reflective portion 24B is radiated forward in a state where the mobile reflective portion 24A is in the first position.

Meanwhile, as shown in FIGS. 3 and 5, light from the light source 22*a* passing between the mobile reflective portion 24A and the general reflective portion 24B is incident to the reflective surface 34*a* of the additional reflector in a state where the mobile reflective portion 24A is in the second position. Therefore, reflected light from the reflective surface 34*a* of the additional reflector 34 is radiated forward, in addition to reflected light from the reflective surface 24*a*1 of the mobile reflective portion 24A and the reflective surface 24*a*2 of the general reflective portion 24B. Since the mobile reflective portion 24A is moved downward, however, only light incident to the upper area of the reflective surface 34*a* reaches the projection lens 28 as reflected light from the reflective surface 34*a*.

In this case, movement of the mobile reflective portion 24A is performed according to a rotational motion centered upon the rotation of the rotating axial member 36 extending in the vehicular lateral direction in a forward vicinity of the light source 22*a*. Therefore, the direction of reflected light from the mobile reflective portion 24A is substantially the same direction in the first and second positions. In other words, in a state where the mobile reflective portion 24A is in the second position, the direction of reflected light from an upper area thereof is substantially the same direction as reflected light from a lower area thereof in a state where the mobile reflective portion 24A is in the first position.

Moreover, the reflective surface 34*a* of the additional reflector 34 is set as a rotational ellipsoid with the center of radiated light from the light source 22*a* as a first focal point, and the rear side focal point F of the projection lens 28 as a second focal point. Therefore, reflected light from the reflective surface 34*a* converges on the rear side focal point F.

As shown in FIG. 6, light from the light source 22*a* passing between the mobile reflective portion 24A and the general reflective portion 24B is incident to the reflective surface 34*a* of the additional reflector 34 even in a state where the mobile reflective portion 24A is in the third position. Therefore, reflected light from the reflective surface 34*a* of the additional reflector 34 is radiated forward, in addition to reflected light from the reflective surface 24*a*1 of the mobile reflective portion 24A and the reflective surface 24*a*2 of the general reflective portion 24B. In this case, the amount of downward movement of the mobile reflective portion 24A is small compared to its state in the second position. Consequently, reflected light from the reflective surface 34*a* of the additional reflector 34 is relatively small, while reflected light from the reflective surface 24*a*1 of the mobile reflective portion 24A is relatively large.

Figure 7:
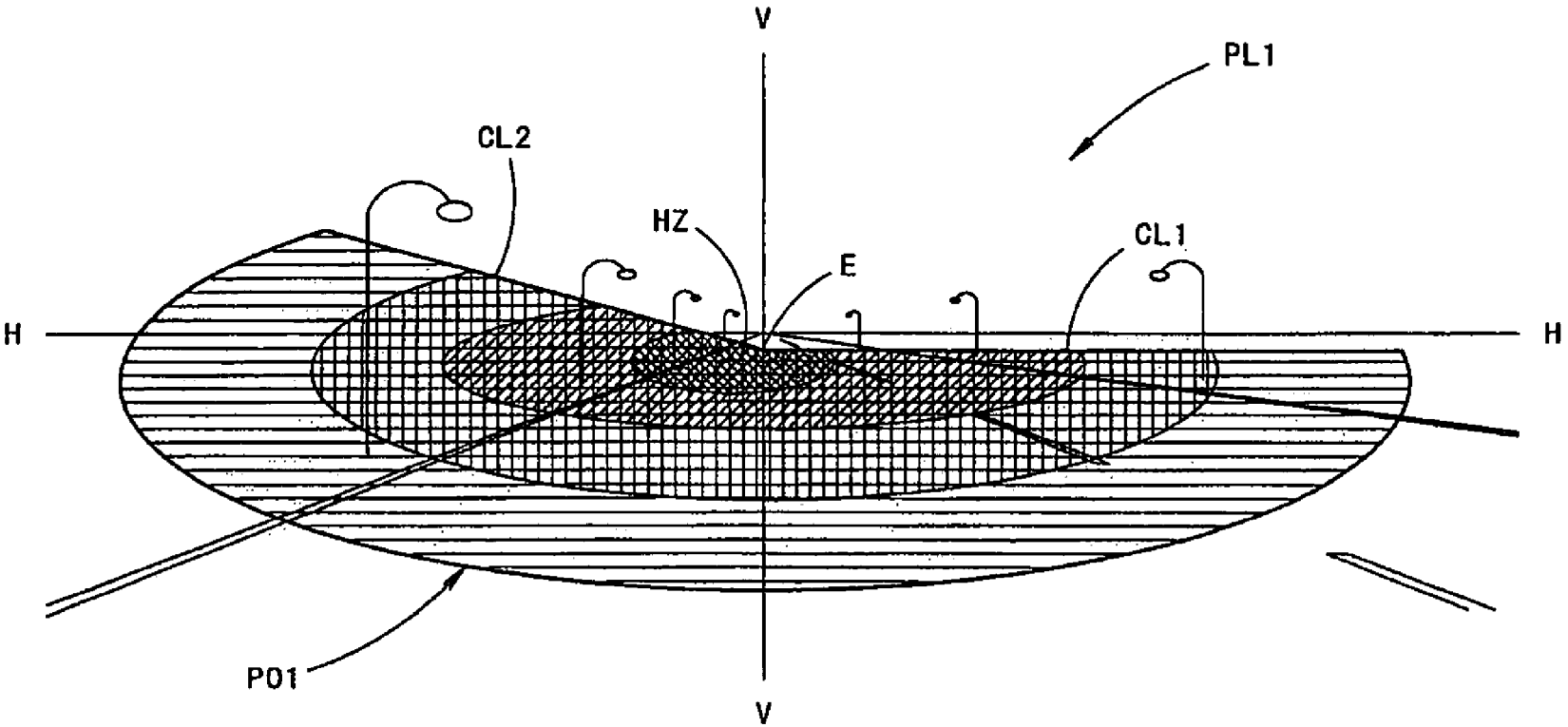
FIG. 7 is a view transparently showing a light distribution pattern formed by light radiated forward from the vehicular headlamp onto an imaginary vertical screen disposed at a position 25 m in front of the lamp, during a state where the mobile reflective portion is in the first position according to an exemplary, non-limiting embodiment of the present invention.
Figure 8:
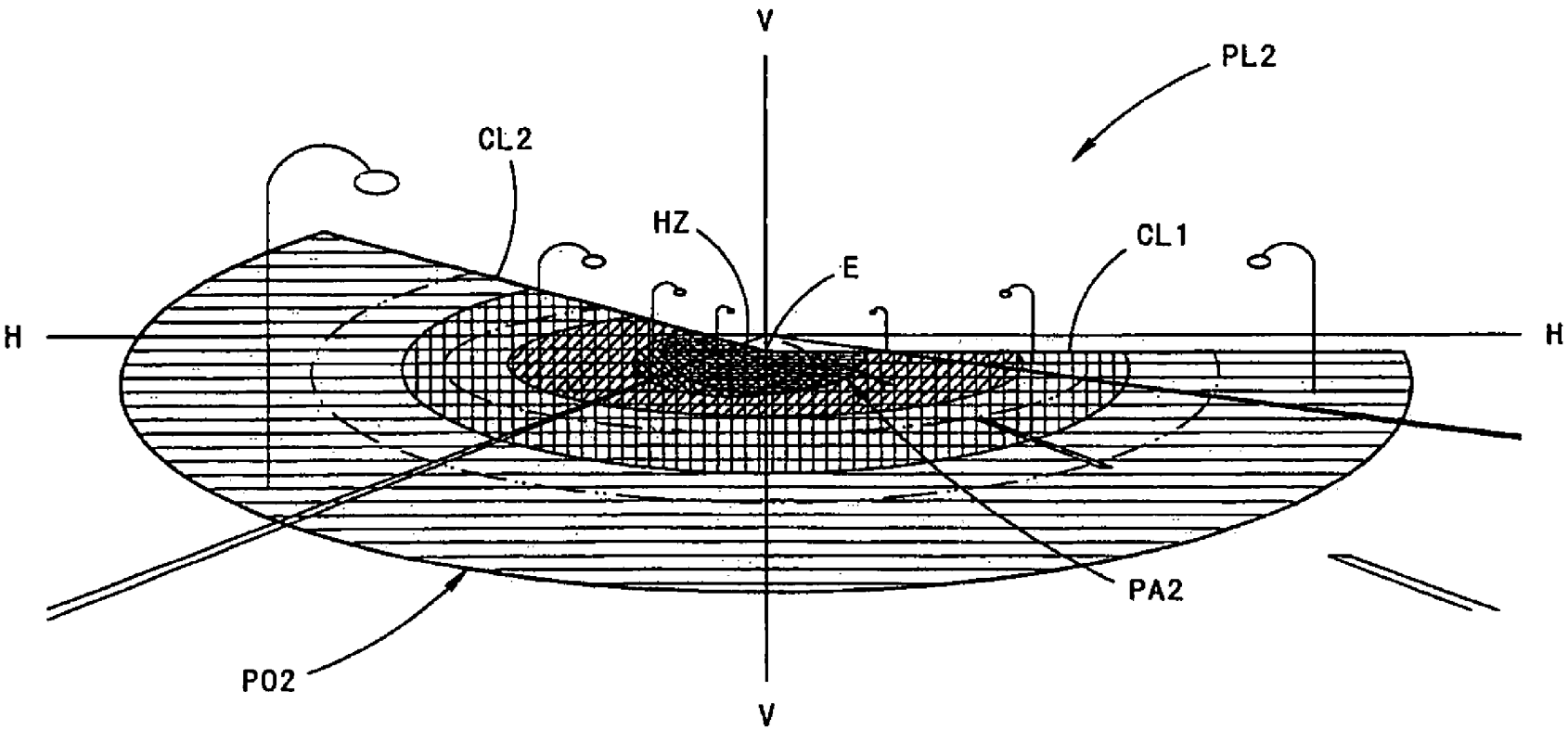
FIG. 8 is a view transparently showing a light distribution pattern formed by light radiated forward from the vehicular headlamp onto the imaginary vertical screen, during a state where the mobile reflective portion is in the second position, according to an exemplary, non-limiting embodiment of the present invention;.
Figure 9:
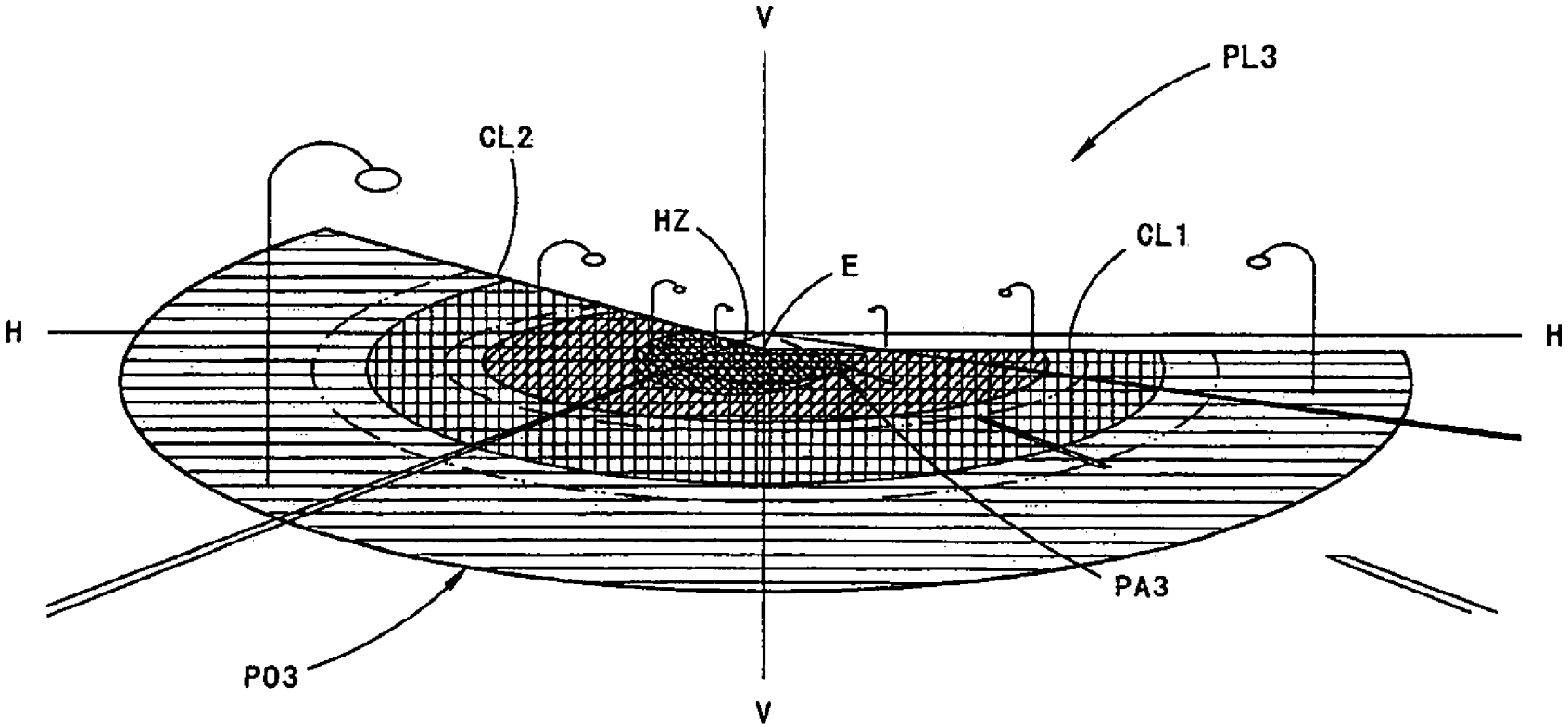
FIG. 9 is a view transparently showing a light distribution pattern formed by light radiated forward from the vehicular headlamp onto the imaginary vertical screen, during a state where the mobile reflective portion is in the third position, according to an exemplary, non-limiting embodiment of the present invention.

FIGS. 7 to 9 are views showing a light distribution pattern formed by light radiated from the vehicular headlamp 10 onto an imaginary vertical screen disposed at a position 25 meters in front of the lamp unit.

FIG. 7 shows a first low-beam distribution pattern PL1 that is formed in a state where the mobile reflective portion 24A is in the first position. FIG. 8 shows a second low-beam distribution pattern PL2 that is formed in a state where the mobile reflective portion 24A is in the second position. FIG. 9 shows a third low-beam distribution pattern PL3 that is formed in a state where the mobile reflective portion 24A is in the third position.

The first, second, and third low-beam distribution patterns PL1, PL2, and PL3 are all low-beam distribution patterns for left side distribution, and have a horizontal cut-off line CL1 on an upper end edge thereof, as well as an oblique cut-off line CL2 that rises at a predetermined angle (approximately 15° for example) from the horizontal cut-off line CL1. The position of an elbow point E, which is an intersection of both cutoff lines CL1, CL2, is set to a position approximately 0.5 to 0.6° downward from a vanishing point H-V in the lamp forward direction. In addition, a hot zone HZ (an area of high-intensity light), is formed in each of the low-beam distribution patterns PL1, PL2, PL3 so as to surround the elbow point E somewhat towards the left. It should be noted that in each of the low-beam distribution patterns PL1, PL2, PL3, a curve showing an outline thereof and a plurality of curves forming a substantially concentric shape are isolux curves. These curves show the light distribution pattern from the peripheral edge becoming gradually brighter towards the hot zone HZ.

As shown in FIG. 7, the first low-beam distribution pattern PL1 coincides with a basic light distribution pattern PO1, which is formed by reflected light from the reflective surface 24*a*1 of the mobile reflective portion 24A and the reflective surface 24*a*2 of the general reflective portion 24B.

As shown in FIG. 8, the second low-beam distribution pattern PL2 is formed as a light distribution pattern synthesized with a basic light distribution pattern PO2, which is formed by reflected light from the reflective surface 24*a*1 of the mobile reflective portion 24A and the reflective surface 24*a*2 of the general reflective portion 24B, and an additional light distribution pattern PA2, which is formed by reflected light from the reflective surface 34*a* of the additional reflector 34. In this case, reflected light, which comes from the upper area of the reflective surface 24*a*1 when the mobile reflective portion 24A is in the first position, cannot be obtained in a state where the mobile reflective portion 24A is in the second position. Therefore, a front side area of the basic light distribution pattern PO2 is darker than the basic light distribution pattern PO1 (an isolux curve of which is shown in FIG. 8 with a two-dotted broken line) formed when the mobile reflective portion 24A is in the first position. Moreover, reflected light from the reflective surface 34*a* of the additional reflector 34 is made to converge on the rear side focal point F. Therefore, the additional light distribution pattern PA2 is formed as a condensed light distribution pattern with a horizontally long spot shape that surrounds the elbow point E, thereby further brightening the hot zone HZ.

FIG. 9 illustrates a third low-beam distribution pattern PL3 synthesized with a basic light distribution pattern PO3, which is formed by reflected light from the reflective surface 24*a*1 of the mobile reflective portion 24A and the reflective surface 24*a*2 of the general reflective portion 24B. FIG. 9 also illustrates an additional light distribution pattern PA3, which is formed by reflected light from the reflective surface 34*a* of the additional reflector 34. In this case, there is more reflected light from an upper area of the reflective surface 24*a*1 in a state where the mobile reflective portion 24A is in the third position, than when in the second position. Therefore, a front side area of the basic light distribution pattern PO3 is brighter than that in the case of the basic light distribution pattern PO2; however, the additional light distribution pattern PA3 is somewhat darker than the additional light distribution pattern PA2.

As described above, the vehicular headlamp 10 is configured as a projection-type vehicular headlamp that radiates light in order to form the low-beam distribution pattern PL and, because the light source bulb 22 is inserted to the reflector 24 from a side of the optical axis Ax so that the bulb 22 is located in a position that extends in the vehicular longitudinal direction, the longitudinal length of the lamp is shortened, thereby making the lamp more compact.

In addition, since the light source bulb 22 is inserted and located in a position below the optical axis Ax, an optical axis side area of the reflective surfaces 24*a*, 24*a*2 of the reflector 24 can be utilized effectively for light distribution control. Moreover, diffusion regions of the low-beam distribution patterns PL1, PL2, PL3 are formed by light reflected from the optical axis side area, thereby enabling sufficient brightness to be secured in the diffusion regions.

Furthermore, the mobile reflective portion 24A positioned substantially directly behind the light source 22*a* in the reflector 24 is structured so as to allow separation and movement downward from the general reflective portion 24B of the reflector 24. Light from the light source 22*a*, passing between both reflective portions 24A, 24B, is incident to additional reflector surface 34*a*, which is located in a rear vicinity of the mobile reflective portion 24A when the mobile reflective portion 24A is separated from the general reflective portion 24B and moved downward.

The additional reflector 34 reflects such incident light forward towards the optical axis Ax, whereby the following effects can be obtained. In a state where the mobile reflective portion 24A is in the pre-separation first position, it is possible to form the first low-beam distribution pattern PL1 with reflected light from the mobile reflective portion 24A and the general reflective portion 24B. In a state where the mobile reflective portion 24A is moved to the second position that is a predetermined distance downward from the first position, it is possible to form the second low-beam distribution PL2 with reflected light from the mobile reflective portion 24A, as well as with light reflected from the general reflective portion 24B and the additional reflector 34. Furthermore, it is possible to form the third low-beam distribution pattern PL3 in-between the first low-beam distribution pattern PL1 and the second low-beam distribution pattern PL2 at the third position between the first position and the second position.

According to the embodiments described above, even in cases where a side insertion type lamp configuration is used in the projection-type vehicular headlamp, sufficient brightness can be secured in the diffusion regions of the low-beam distribution patterns PL1, PL2, and PL3. Light can also be radiated so to form the low-beam distribution patterns PL1, PL2, and PL3 depending upon vehicle traveling conditions.

Moreover, in the above-described embodiments, movement of the mobile reflective portion 24A may be performed according to a rotational motion centered upon the rotation of the rotating axial member 36 extending in the vehicular lateral direction in the forward vicinity of the light source 22*a*. Therefore, the direction of reflected light from the mobile reflective portion 24A can be set so as to be substantially the same direction in the first position and second position, thereby preventing large disturbances from occurring in the low-beam distribution patterns PL1, PL2, and PL3.

Additionally, the reflective surface contour of the additional reflector 34 may be set as a rotational ellipsoid with the center of radiated light from the light source 22*a* as a first focal point, and a rear side focal point F1 as a second focal point. Therefore, it is possible to form the additional light distribution patterns PA2, PA3, which are formed by reflected light from the additional reflector 34, as spot-shaped condensed light distribution patterns. Moreover, the additional light distribution patterns PA2, PA3 are formed near the elbow point E of the low-beam distribution patterns PL1, PL2, PL3, whereby long distance visibility can be increased.

Further, the light source 22*a* may be structured as a line segment light source extending in the direction of the bulb central axis Ax1. Therefore, a light ray bundle of the highest intensity heading in a direction orthogonal to the bulb central axis Ax I can be radiated to the additional reflector 34, which is positioned substantially directly behind the light source 22*a*, whereby the additional light distribution patterns PA2, PA3 can be made even brighter.

Moreover, since the light source 22*a* may be structured as a line segment light source extending in the direction of the bulb central axis Ax1, the additional light distribution patterns PA2, PA3 can be formed as horizontally long condensed light distribution patterns. Thus, an area of the road surface far away from the front of the vehicle can be sufficiently lit without excessively lighting an area closer to the vehicle. Consequently, long distance visibility can be further increased.

Furthermore, the additional light distribution pattern PA2 may be added to the low-beam distribution pattern PL2 formed in the high vehicle speed zone, as compared to the low-beam distribution pattern PL1 formed in the low vehicle speed zone. The front side area of the basic light distribution pattern PO2 thereof is darker than the basic light distribution pattern PO1, thereby effectively increasing long distance visibility. In addition, the additional light distribution pattern PA3 darker than the additional light distribution pattern PA2 is added to the low-beam distribution pattern PL3 formed in the intermediate vehicle speed zone, as compared to the low-beam distribution pattern PL1 formed in the low vehicle speed zone. The front side area of the basic light distribution pattern PO3 thereof has a brightness in-between that of the basic light distribution patterns PO1, PO2, thereby effectively increasing long distance visibility. Thus, long distance visibility can be gradually increased in accordance with increases in the vehicle speed.

The separation position of the upper end edge of the mobile reflective portion 24A and the general reflective portion 24B may be set to a position at generally the same height as the optical axis Ax. Therefore, a reflection area above the optical axis Ax can be secured as the general reflective portion 24B. Reflected light from the general reflective portion 24B can easily form the basic light distribution patterns PO1, PO2, PO3 as light distribution patterns with sufficiently bright diffusion regions. Light flux incident to the mobile reflective portion 24A or the additional reflector 34 can also be sufficiently secured.

The shade 32 for blocking a portion of reflected light from the reflector may be disposed in the vicinity of the rear side focal point F of the projection lens 28, such that the upper end edge thereof is positioned in the vicinity of the optical axis Ax. Therefore, the low-beam distribution patterns PL1, PL2, PL3 can be formed with the horizontal and oblique cut-off lines CL1, CL2 on the upper end edge. Moreover, in this case, the additional light distribution patterns PA2, PA3 can be formed near the horizontal and oblique cut-off lines CL1, CL2 by reflected light from the additional reflector 34.

The additional reflector 34 directly reflects light from the light source 22*a*, and this reflected light passes through the projection lens 28 so as to be radiated toward the forward direction. Therefore, the radiated light can be controlled with high precision, and it is possible for the resulting light distribution pattern formed to have a quality identical to the light distribution pattern formed by light from the light source 22*a*, which is reflected by the reflector 24 and passes through the projection lens 28. Thus, the vehicular headlamp 10 is capable of forming a plurality of types of light distribution modes and controlling the radiated light thereof with high precision, in addition to keeping to a minimum any noticeable difference when switching between modes.

Furthermore, an embodiment of the present invention has a structure that switches between modes through movement of the mobile reflective portion 24A, which has a function for controlling light reflection. Therefore, light from the light source 22*a* can be more effectively utilized compared to a conventional device wherein a a shutter would be opened or closed to switch between modes.

While the additional light distribution patterns PA2, PA3 formed by reflected light from the additional reflector 34 are described as being formed as spot-shaped condensed light distribution patterns, the additional light distribution patterns PA2, PA3 may be formed as other light distribution patterns (e.g., a wide diffusion light distribution pattern that is greatly diffused in the lateral direction, or the like) by changing the surface contour of the reflective surface 34*a* of the additional reflector 34, as appropriate.

The above description also describes the additional reflector 34 as being integrally formed with the general reflective portion 24B of the reflector 24 in the present embodiment. However, the additional reflector 34 may be separately formed.

Furthermore, the light source bulb 22 is described above as being inserted from a direction directly to the side of the reflector 24 but deviations in the insertion angle may be made while substantially producing the same effects as the embodiments of the invention described above. For example, the amount of deviation in either the vertical direction or the longitudinal direction of the insertion angle may be approximately 30° or less while retaining all or most of the functions described above.

Figure 10:
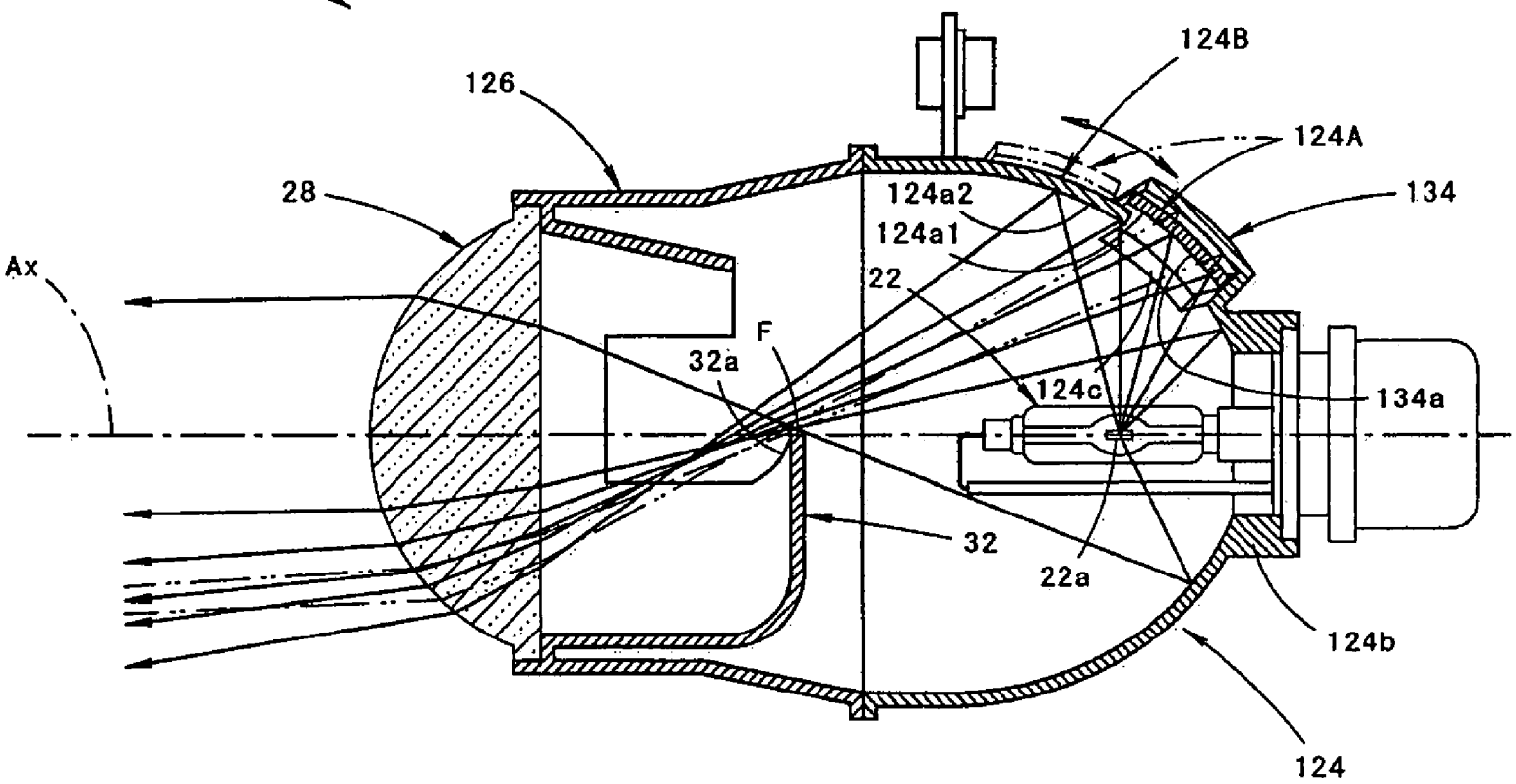
FIG. 10 is a lateral cross-sectional drawing showing a lamp unit according to an exemplary, non-limiting embodiment of the present invention.

FIG. 10 is a lateral cross-sectional drawing showing a lamp unit 120 according to an exemplary embodiment of the present invention.

As shown in the figure, the placement of the light source bulb 22 and the configuration of a reflector 124 and an additional reflector 134 in the lamp unit 120 differ from that in the lamp unit 20 of the above embodiment. Accordingly, the shape of a holder 126 is also slightly different. However, the other features of the lamp unit 120 are substantially the same as those described in relation to the previously described embodiments.

In the lamp unit 120, the light source bulb 22 is inserted from a rear side into an opening portion 124*b* formed in a rear top portion of the reflector 124, such that a bulb central axis thereof coincides with the optical axis Ax.

Furthermore, the reflector 124 has a mobile reflective portion 124A positioned somewhat behind the light source 22*a* and above, or substantially above, the optical axis Ax, and is otherwise formed from a general reflective portion 124B. The reflector 24 is structured so as to reflect light from the light source 22*a* forward towards the optical axis Ax.

An opening portion 124*c* with a substantially horizontally oblong shape is formed on a portion of the general reflective portion 124B that is positioned somewhat behind the light source 22*a* and above, or substantially above, the optical axis Ax. The mobile reflective portion 124A has an exterior shape that is substantially identical to the opening portion 124*c*, and is disposed in the vicinity of the rear surface side of the general reflective portion 124B so as to face the opening portion 124*c*.

Reflective surfaces 124*a*1, 124*a*2 of the mobile reflective portion 124A and the general reflective portion 124B have a substantially ellipsoid-shaped cross section, with an eccentricity thereof set so as to gradually increase from a vertical cross section toward a horizontal cross section. Thus light from the light source 22*a* reflected by the reflective surfaces 124*a*1, 124*a*2 substantially converges near the rear side focal point F in the vertical cross section. Moreover, the convergence position of light in the horizontal cross section is moved considerably forward.

The mobile reflective portion 124A is configured so as to move between a first position shown by a solid line in the figure and a second position shown by a two-dotted broken line obliquely in front of and above the first position. This movement is performed in a rotational motion around an axial line extending in the lateral direction in the front vicinity of the light source 22*a*. This rotational motion is performed in a continuous manner (or in stages) through driving of an actuator (not shown).

An additional reflector 134 is provided in the vicinity behind the mobile reflective portion 124A of the reflector 124, and integrally formed with the general reflective portion 124B of the reflector 124. A reflective surface 134*a* of the additional reflector 134 has an exterior shape substantially identical to the opening portion 124*c* of the general reflective portion 124B. Furthermore, at times when the mobile reflective portion 124A of the reflector 124 has separated from the general reflective portion 124B and moved obliquely up and forward, as shown by the two-dotted broken line in the figure, the additional reflector 134 is designed to reflect light incident from the light source 22*a* passing between both reflective portions 124A, 124B forward towards the optical axis Ax.

The reflective surface 134*a* of the additional reflector 134 in this case has a surface contour with a high tendency to condense light toward the vicinity of the rear side focal point F of the projection lens 28. More specifically, the surface contour of the reflective surface 134*a* is set as a rotational ellipsoid with the center of radiated light from the light source 22*a* as a first focal point, and a point in the vicinity of the rear side focal point F of the projection lens 28 as a second focal point.

Figure 11:
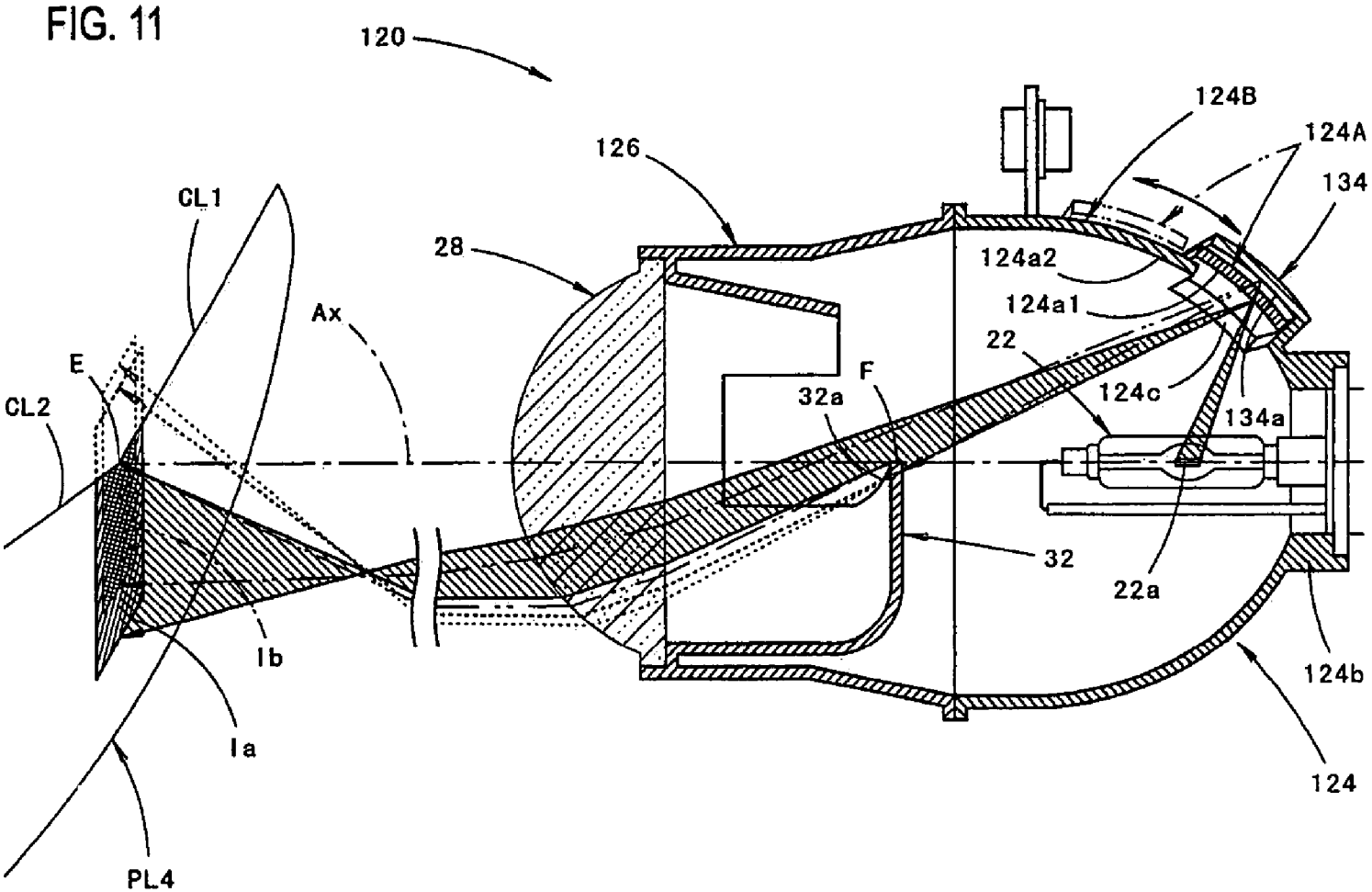
FIG. 11 is a drawing showing a light path and an inverted projection image of a lamp unit according to an exemplary, non-limiting embodiment of the present invention.

FIG. 11 illustrates a path of light from the light source 22*a*, which is reflected by the reflective surface 134*a* of the additional reflector 134 and the reflective surface 124*a*1 of the mobile reflective portion 124A of the reflector 124, as well as two inverted projection images that are formed by the reflected light.

As shown by a solid line in the figure, light reflected by the reflective surface 124*a*1 of the mobile reflective portion 124A passes in the upper vicinity of the upper end edge 32*a* of the shade 32 and is incident to the projection lens 28, thereby forming an inverted projection image Ia that is positioned in the vicinity of the elbow point E.

The inverted projection image Ia is an image with a substantially vertically oblong shape, since the light source 22*a* is structured as a line segment light source extending in the longitudinal direction on the optical axis Ax. In this case, a portion of reflected light from the reflective surface 124*a*1 of the mobile reflective portion 124A is blocked by the shade 32, producing an inverted projection image Ia in which an upper portion of the substantially vertically oblong-shaped image is missing along the shape of the upper end edge 32*a* of the shade 32. Thus a portion of the horizontal and oblique cut-off lines CL1, CL2 of a low-beam distribution pattern PL4 is formed near the elbow point E.

As shown by a two-dotted broken line in the figure, light reflected by the reflective surface 134*a* of the additional reflector 134 passes in the upper vicinity of the upper end edge 32*a* of the shade 32 and is incident to the projection lens 28, thereby forming an inverted projection image Ib that is positioned in the vicinity of the elbow point E.

Similar to the inverted projection image Ia, the inverted projection image Ib is also an image with a substantially vertically oblong shape, with an upper portion thereof missing along the shape of the upper end edge 32*a* of the shade 32. However, the inverted projection image Ib is an image that is smaller and brighter than the inverted projection image Ia, and is also more generally displaced upward than the inverted projection image Ia.

In order to form the inverted projection image Ib as an image smaller and brighter than the inverted projection image Ia, the reflective surface 134*a* of the additional reflector 134 is positioned further away from the light source 22*a* than the reflective surface 124*a*1 of the mobile reflective portion 124A. This is because an estimated angle from the light source 22*a* with respect to a point on the reflective surface 134*a* is smaller than an estimated angle from the light source 22*a* with respect to a point on the reflective surface 124*a*1 of the mobile reflective portion 124A. In addition, the general displacement of the inverted projection image Ib from the inverted projection image Ia upward is due to the reflective surface 134*a* of the additional reflector 134 having a surface contour with a high tendency to condense light toward the vicinity of the rear side focal point F of the projection lens 28.

An additional embodiment of the invention includes the light source 22*a* being structured as a line segment light source extending in the direction of the optical axis Ax as in the lamp unit 120, wherein the low-beam distribution pattern PL4 formed by radiated light thereof is formed through overlapping a portion positioned below the elbow point E and the inverted projection image with a substantially vertically oblong shape. This embodiment results in a structure that is extremely effective for varying the position and size of the inverted projection image with a substantially vertically oblong shape through movement of the mobile reflective portion 124A.

In other words, the inverted projection image Ib formed when the mobile reflective portion 124A is in the second position is an image that is smaller and brighter than the inverted projection image Ia, and is also more generally displaced upward than the inverted projection image Ia. Therefore, an area in the vicinity of the elbow point E can be made bright, while also allowing a lower end rim area of the low-beam distribution pattern PL4 to be made darker. Thus, an area of the road surface far away from the front of the vehicle can be sufficiently lit without excessively lighting up a closer area thereof. Consequently, long distance visibility can be sufficiently increased.

While the above-described embodiments may include the mobile reflective portion 124A as being disposed substantially directly above the optical axis Ax, a configuration in which the mobile reflecting portion 124A is disposed in another position is also possible. For example, a configuration is possible in which a mobile reflective portion similar to the mobile reflective portion 124A of the present modification may be disposed on a side of the optical axis Ax, whereby a lateral diffusion angle of the low-beam distribution pattern PL4 is changed by movement thereof.

The previous description of embodiments is provided to enable a skilled artisan to make and use the present invention. Various modifications to these embodiments will be readily apparent to those skilled in the art, and the generic principles and specific examples provided herein may be applied to other embodiments without the use of inventive facility. For example, some or all of the features of different embodiments discussed about may be deleted from the embodiment. Therefore, the present invention is not intended to be limited to the embodiments described herein but it is to be accorded the widest scope defined only by the claims below and equivalents thereof.

What is claimed is:

1. A vehicular headlamp comprising a projection lens, a light source, and a reflector; wherein said projection lens is disposed on an optical axis that extends in a vehicular longitudinal direction;

said light source is disposed to a rear side of a rear side focal point of said projection lens; and said reflector reflects light from the light source in a forward direction which is substantially toward the optical axis, characterized in that:

a portion of the reflector is structured as a mobile reflective portion so as to allow separation from a remaining general reflective portion through movement of the mobile reflective portion in a predetermined direction; and an additional reflector is provided in a rear vicinity of the mobile reflective portion, to which some light that is incident from the light source passes the mobile reflective portion when the mobile reflective portion separates from the general reflective portion and moves in the predetermined direction, wherein said incident light is reflected forward and substantially toward the optical axis.

2. The vehicular headlamp according to claim 1, characterized in that the additional reflector has a reflective surface contour with a high tendency to condense light toward a vicinity of the rear side focal point.

3. The vehicular headlamp of claim 1, characterized in that the mobile reflective portion is structured such that movement thereof is performed according to a rotational motion centered upon a point in the vicinity of the light source.

4. The vehicular headlamp of claim 1, characterized in that the light source is structured from a light-emitting portion of a light source bulb inserted to the reflector from a position relatively to the side of the optical axis so as to be located in a position substantially below the optical axis.

5. The vehicular headlamp according to claim 4, characterized in that:

the mobile reflective portion is disposed substantially directly behind the light source in relation to a front end projection lens of the vehicular headlamp; and a separation position of an upper end edge of the mobile reflective portion and a lower end edge of the general reflective portion is set to a position at generally the same height as the optical axis.

6. The vehicular headlamp of claim 1, characterized in that:

the light source is structured from a light-emitting portion of a light source bulb inserted to the reflector from a rear side of the vehicular headlamp in relation to a front end projection lens of the vehicular headlamp, the light source being located substantially on the optical axis; and wherein the mobile reflective portion is disposed substantially above the optical axis.

7. The vehicular headlamp of claim 1, characterized in that a shade for blocking a portion of reflected light from the reflector is disposed in a vicinity of the rear side focal point so as to position an upper end edge of the shade in a vicinity of the optical axis.

* * * * *